US005225165A

United States Patent [19]

Perlman

[11] Patent Number: 5,225,165

[45] Date of Patent: Jul. 6, 1993

[54] MICROCENTRIFUGE TUBE WITH UPWARDLY PROJECTING LID EXTENSION

[75] Inventor: Daniel Perlman, Arlington, Mass.

[73] Assignee: Brandeis University, Waltham, Mass.

[21] Appl. No.: 883,420

[22] Filed: May 11, 1992

[51] Int. Cl.[5] ..... B01L 3/00

[52] U.S. Cl. ..... 422/102; 436/810; 435/296; 206/815; 215/295; 215/305; 215/306; 220/260; 220/269; 220/270; 220/375

[58] Field of Search ..... 422/99, 102, 103; 436/810; 435/296; 215/305, 306, 295; 220/260, 335, 375, 269, 270; 206/815

[56] References Cited

U.S. PATENT DOCUMENTS

| | | | |
|---|---|---|---|
| 4,534,483 | 8/1985 | Kassis et al. | 215/306 |
| 4,674,640 | 6/1987 | Asa et al. | 215/306 X |
| 4,713,219 | 12/1987 | Gerken et al. | 422/102 |
| 4,755,356 | 7/1988 | Robbins et al. | 422/102 |
| 4,858,502 | 8/1989 | Warburg | 81/3.57 |
| 4,872,563 | 10/1989 | Warder et al. | 422/102 X |
| 4,956,298 | 9/1990 | Diekmann | 422/102 X |
| 4,991,759 | 2/1991 | Scharf | 206/815 X |

*Primary Examiner*—James C. Housel
*Assistant Examiner*—Maureen M. Wallenhorst
*Attorney, Agent, or Firm*—Lyon & Lyon

[57] ABSTRACT

A microcentrifuge tube or other thermoplastic sample container having a round opening and a frictionally seated sealing lid, the lid having a size and shape to cover the perimeter of the tube opening and maintain the inside of the tube free of any contaminant. The lid viewed on an upright closed container has a downwardly extending annular portion shaped to sealing fit inside the opening, the lid further having an integral upwardly projecting lid extension configured and arranged on top of the lid to facilitate aseptic opening, grasping and identification-labeling of the container. The location, angle and size of the lid extension allow mechanical pressure to be used on top of the lid, rather than beneath the lid, to open the container. The improved apparatus and method for opening the container functions to prevent sample contamination which could otherwise occur when a fingernail or other container opening instrument is inserted beneath, and contacts some portion(s) of the underside of the lid. The location, size, and surface finish of the lid extension also allow grasping of the microcentrifuge tube after placement in a centrifuge rotor or storage rack, as well as labeling the tube for sample identification and tracking purposes.

10 Claims, 1 Drawing Sheet

MICROCENTRIFUGE TUBE WITH UPWARDLY PROJECTING LID EXTENSION

BACKGROUND OF THE INVENTION

This invention relates to lid designs for laboratory sample containers (e.g., microcentrifuge tubes) which facilitate their opening.

Microcentrifuge tubes are small plastic tubes which are typically tapered, conical or rounded, and closed at one end. The tubes are capable of holding 0.4–2.0 ml liquid, and are constructed to withstand forces typically in excess of 10,000 times their own weight (10,000× g) during centrifugation. These tubes are used widely in biotechnology laboratories as vessels for handling radioisotope chemicals, for storing biochemicals, for performing biochemical reactions, and for handling sterile contaminant-free samples. They have tight fitting lids whose size and shape protect and cover the perimeter of the tube opening, and help maintain the inside of the tube in an aseptic condition. The lids are generally attached to the tubes by a flexible hinge and are sealed to the tube by pressing them downward against a resisting frictional force. In this sealing process, the annular sealing portion of the underside of the lid, shaped to a sealing fit inside the tube opening, is forced downward into the tube and compressed. The lids are secured against accidental opening by a number of means which vary in effectiveness, including friction force-fit of the lid in the tube, integrated lid "catches" which secure the lid (or secure a lid over-cover) to a lip flange provided on the tube, or alternatively, by separate lid clamps which may be slid or snapped into place after the lid has been closed. Examples of such tubes are described and advertised for sale in the current 1992–1993 scientific apparatus catalogs published by VWR Scientific (pp. 320–323), and Curtin Matheson Scientific (pp. 11/260–11/263) hereby incorporated by reference.

For subsequently aiding in unseating and opening the sealed, or sealed and secured lid, the generally flat lid opposite the lid hinge is usually extended horizontally beyond the outer diameter of the tube's lip flange to provide a standard lifting tab. A thumb, thumbnail or opener device may be used to lift upward on this tab. Warburg, U.S. Pat. No. 4,858,502 describes a specialized opener tool designed to open the microcentrifuge tube. The tool contains a recess space and other features shaped to engage the lid's lifting tab thereby allowing the tube to be opened.

In the process of opening the microcentrifuge tube, finger and/or tool-contact with the underside of the lid lifting tab may contribute to contamination of the sample in the tube. For example, Applicant has discovered that when a finger or fingernail is inserted beneath the lifting tab and pressure is applied upward on the lid, as the lid opens, the finger and/or fingernail may inadvertently contact the annular sealing portion of the underside of the lid. Analysis of the relative motions of the finger, e.g., thumb, and the lid during opening of the tube shows that as the lid "snaps" open and pivots backward on its hinge, the rapidly diminishing contact angle between the rotating lid and the finger causes such undesirable inadvertent contact. Subsequent reclosing of the lid can introduce contaminants from the finger into the tube. Even the use of surgical gloves cannot assure that cross-contamination between successively opened microcentrifuge tubes will not occur. The container opener tool of Warburg in U.S. Pat. No. 4,858,502 reduces the incidence of contamination of microcentrifuge tube samples during the process of opening the tubes. Applicant has found, however, that when a trace of liquid or other contaminant substance is introduced into the recess of the Warburg device, this substance may be transferred to the underside of the lid lifting tab. From this location, during the subsequent closing of the tube and contact between the lip of the tube and underside of the lid, migration of the contaminant into the tube is possible.

SUMMARY OF THE INVENTION

Applicant has discovered that the addition of a structural element to the above-described microcentrifuge tube lid solves many of the above-described problems and provides other advantages. The added structural element permits opening of the tube without risk of contact of any portion of the side or underside of the lid including the lid side edge, the lid lifting tab, or the annular sealing portion of the underside of the lid.

According to the present invention, there is provided a laboratory sample container, such as a microcentrifuge tube, with a round opening and a correspondingly sized, hinged or tethered frictionally-seated sealing lid for the container. The lid is sized and shaped to seal and cover the perimeter of the tube opening and maintain the inside of the tube free of any contaminant. The underside of the lid includes a downwardly extending annular portion shaped to sealing fit inside the tube opening. The tube also has a lid with at least one integral upwardly projecting lid extension suitably configured and arranged on top of the lid so that thumb pressure or other suitable mechanical pressure applied to a surface of the lid extension, generally toward the longitudinal axis of the tube in the direction of the lid hinge, unseats and moves the lid from the sealed container without any physical contact occurring with the side or underside of the lid.

Thus, in a first aspect, the invention features a microcentrifuge tube having a lid with a lid extension extending upwardly from the lid. This extension is configured and arranged to aid movement of the lid from the tube by application of pressure to a surface of the lid extension.

In preferred embodiments, the microcentrifuge tube when viewed upright, includes a container having an upper opening defined by a perimeter wall having an upper perimeter wall surface, and a lid. The lid includes a sealing wall having a lower surface and a lower annular sealing portion positioned adjacent to, and extending downwardly from the lower surface. The annular sealing portion of the lid is adapted to fit within the upper opening of the tube and sealingly mate with the sides of the tube's inner perimeter wall, while the lower surface of the lid is adapted to mate (and preferably also seal) with the upper perimeter wall surface of the tube. The lid when viewed on an upright closed tube, has an upper surface and, extending upwardly from this surface, a lid extension which is configured and arranged such that when the annular portion of the lid is frictionally held within the upper opening of the container, this annular portion can be removed from the upper opening by application of pressure on a surface of the lid extension.

In yet other preferred embodiments, the lid extension is formed as an integral part of a thermoplastic microcentrifuge tube lid by standard procedures. When viewed on an upright closed microcentrifuge tube, the lid extension has an upward projection (preferably angled at 20–80 degrees elevation above a generally horizontal plane defining the lid upper surface). The lid extension is fabricated of molded plastic in the shape or form of a flat or curved flap, horn-like projection or other physical extension of the top surface of the lid. Preferably, the microcentrifuge tubes are constructed with hinged or tethered lids. On such lids, the upper portion of the lid extension is generally angled away from the hinge or tether. It is also preferred that with hinged or tethered lids, the lid extension is attached within the half of the lid distal from the hinge. Such attachment on or near the original lifting tab and relatively far from the hinge (which serves mechanically as the lid's fulcrum) functions to increase leverage. This leverage facilitates opening of the container. Using one's finger to apply pressure to the lower surface of a lid extension whose upper portion is angled away from the hinge, a component of the applied force is directed upward, thereby helping lift the side of the lid opposite the hinge. When the lid is unseated and then pivots backward on its hinge one's finger tends to maintain contact with the lid extension and contamination of the underside of the lid and the microcentrifuge tube is avoided.

Also preferably included as a feature of the present invention and helping to prevent contamination, is the presence of the standard lid tab (described above) previously used in other microcentrifuge tubes with generally flat lids. This standard lid tab, extending horizontally 1/16–⅛ inch beyond the lip flange of the microcentrifuge tube, also extends beyond the attachment position for the lid extension of the present invention, i.e., the lid extension is indented from the side-edge of the lifting tab. Consequently, the lifting tab cooperates with the lid extension to produce a finger-stop which prevents a finger from accidentally slipping or rotating over the lid side edge as the lid opens and thus contaminating the underside of the lid. Thus the top surface of a standard lid lifting tab serves a new function in the present invention in helping prevent contamination of the microcentrifuge tube by the finger. The tube is designed such that a finger only contacts the structural elements located on the upper surface of the lid and nothing below this surface, and certainly not the annular portion of the lid.

Another aspect of the present invention features a lid extension on a closed container such as a microcentrifuge tube. The extension is a flap or other upwardly angled physical extension of the lid, of sufficient size to allow grasping of the lid extension (and thereby the closed container) with two fingers when the lid rather than the body of the microcentrifuge tube is physically accessible. For example, when the tube is immersed in a crushed ice bath or is hanging by its lip flange in a microcentrifuge rotor or microcentrifuge tube storage rack, the lid extension provides a useful handle for grasping, lifting and transporting the tube.

In preferred embodiments, the lid extension is in the form of an upwardly angled flat, curved and/or rounded flap or horn-like projection on top of the lid. The lid extension is at least ¼ inch in length, so that it may be conveniently grasped with one's fingers.

Preferably the upper portion of the lid extension flap is angled away from the hinge, i.e., the extension lies at an obtuse angle with respect to the hinge.

Another aspect of the present invention features a lid extension on a closed container, such as a microcentrifuge tube, having an upwardly angled flap or other upward physical extension of the lid, with the size, shape, contour, and surface finish of the extension being suitable for receiving sample identification markings.

It is preferred that the lid extension has a flat or gently curved plastic flap whose radius of curvature is at least approximately ¼ inch and whose surface area is at least 1/16 inch$^2$, thereby allowing handwritten identification of a sample, e.g., by number or letter.

Preferably, the lid extension has a flat or gentle curved plastic flap in which at least one side of the flap has a matte-finished or otherwise modified surface, allowing the surface to receive and retain indicia, such as handwritten sample identification markings, on individual microcentrifuge tubes.

A further aspect of the present invention features a method for opening a closed container such as a microcentrifuge tube and maintaining its interior in an aseptic or contaminant-free condition. The method includes providing a closed container with a lid whose top surface and underside are shaped to cover and hermetically seal the opening of the container and whose top surface includes an upwardly angled physical extension of the lid (lid extension), applying pressure to the lid extension to cause the lid to become unseated without contacting or contaminating the underside of the lid, and removing the lid or pivoting the lid on its hinge to open the container without contacting or contaminating the underside of the lid or interior of the container.

The lid extension of this invention provides an improved means of opening frictionally-seated and sealed lidded containers such as microcentrifuge tubes. While obviating the need for a specialized lid opener tool, the lid extension also provides an alternative to using one's fingernail to lift or pry the lid using its underside. The utility of the present invention can be further understood from the discussion of problems associated with the use of the microcentrifuge tube outlined by Warburg, U.S. Pat. No. 4,858,502 in his invention of a specialized opener for the microcentrifuge tube:

"It is important when using these tubes that the inner portion of the lid not be touched by anything which is non-sterile since the enzymes or other chemicals which are commonly present in such tubes are sensitive to contaminating agents (e.g., RNAases and proteases) present on either human fingers or articles touched by humans. In addition, some microcentrifuge tubes must be kept at a constant specific temperature (e.g., −20° C. or 0° C.) when they are used for certain reactions and it is useful to be able to open them quickly without altering these conditions. The opener preferably does not touch the inner portion of the lid and thus does not contaminate the contents of the tube. It allows quick opening of tubes, even when held in racks, thus permitting these tubes to be opened without disturbing the temperature of the tube. The opener can be used so that the lid does not fly open, but rather is gently removed from the tube. This prevents the formation of aerosols which occur when the pressure inside a tube is rapidly decreased and thus the contents become airborne. Such an occurrence can be extremely dangerous when there is a radioactive solution in the tube, or when bacterial or viral solutions are present in the tube. Further, the opener does not distort or deform the shape of the lid during opening of the microcentrifuge tube".

Applicant points out that in certain synthetic and analytical procedures including but not limited to DNA polymerase synthetic amplification of DNA sequences (PCR) as well as in forensic analysis of DNA samples in paternity and criminal investigations for example, any possibility of sample contamination in the microcentrifuge tube must be eliminated. The present invention, by preventing finger-contact with the underside of the tube's lid during opening, can be used to improve procedural quality assurance that sample contamination does not occur. In the opening of prior art microcentrifuge tubes, sample contamination can and does occur by both direct and indirect routes. As an example of the latter route, it is possible after repeated use, for the container opener of Warburg, U.S. Pat. No. 4,858,502 to become sufficiently contaminated to transfer material from one tube to another during physical engagement of the underside of successive lids, which material may then migrate into the tube during subsequent opening and/or closing of the lid. With the present invention, however, physical contact with the lid during opening of the container is limited to contact with only the upwardly projecting lid extension.

The benefits of the presently invented lid extension are obtained at some added expense compared to known (horizontally disposed) lid-opening tabs found on conventional hinged plastic lids. While horizontal tabs, for example, have little or no impact on overall package size and thus on shipping and storage costs, the upward lid extensions increase the overall height of the container, thereby increasing these cost parameters. Nevertheless in the present invention, it is recognized that some increase in lid height allows provision of the lid extension which can reduce or eliminate sample contamination accompanying finger-mediated opening of certain containers such as microcentrifuge tubes.

The presently invented lid extension also serves to provide a grasping means for the microcentrifuge tube particularly when only the lid of the tube is exposed to view, such as when the tube is supported by its lip flange in a microcentrifuge rotor or storage rack or when the tube is immersed in an ice bath.

The lid extension when fabricated with a substantially flat or gently curved markable surface (e.g., a polyolefin thermoplastic surface with a matte finish, a painted finish or an etched finish), also provides a means to facilitate sample registration, identification marking, and tracking.

Other features and advantages of the invention will be apparent from the following description of a preferred embodiment thereof which is by way of example only, and from the claims.

DESCRIPTION OF THE PREFERRED EMBODIMENTS

The drawings will first be briefly described.

DRAWINGS

Figure 1:
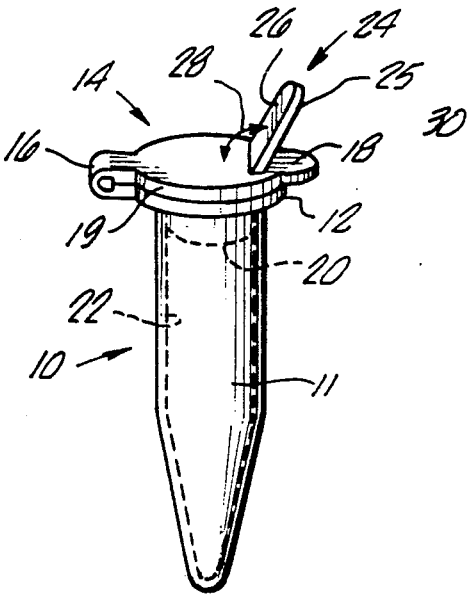
FIG. 1 is a perspective view of a closed microcentrifuge tube, lid, and lid extension of this invention.
Figure 2:
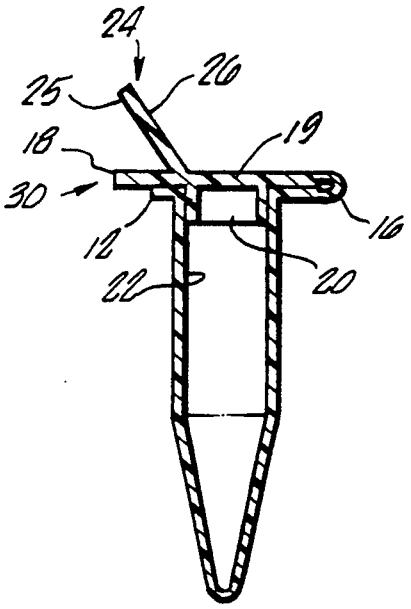
FIG. 2 is a longitudinal sectional view of the tube, lid, and lid extension shown in FIG. 1.
Figure 3:
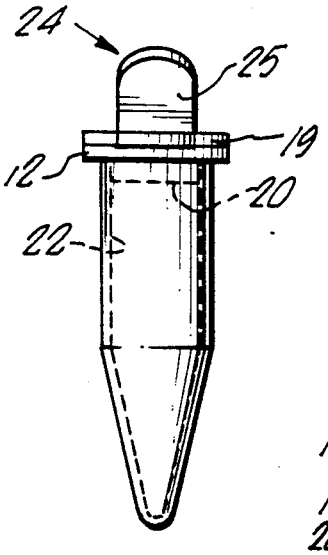
FIG. 3 is a frontal view of the tube, lid, and lid extension shown in FIG. 1.
Figure 4:
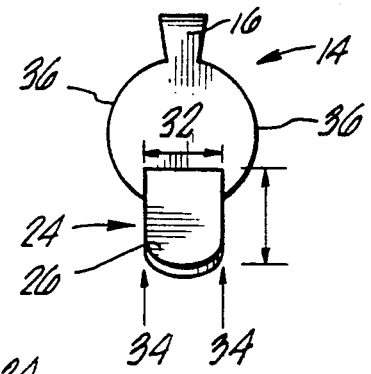
FIG. 4 is a plan view of the top of the lid and lid extension shown in FIG. 1.
Figure 5:
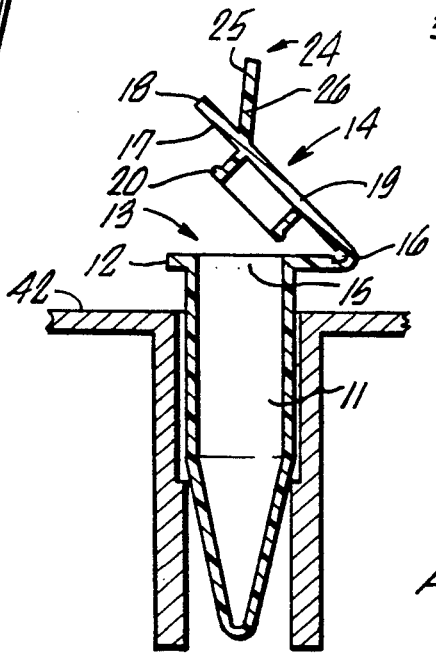
FIG. 5 is a sectional view of a storage rack holding an open microcentrifuge tube, lid, and lid extension.

Referring to the Figures, microcentrifuge tube 10 (approximate length 1½ inches and approximate diameter 7/16 inch) is typically injection-molded from virgin polypropylene or polyethylene with lip flange 12 which can be used to support the tube in a microcentrifuge rotor or in a storage rack. Generally, the microcentrifuge tube is formed with a container 11 having an upper perimeter wall surface 13 (defining an upper opening 15) adapted to mate with lid 14 (see FIG. 5). Lid 14, includes lid hinge 16, lid lifting tab 18 (previously used in other microcentrifuge tubes as the lid lifting means for opening the container with either a fingernail or a container opener tool), lid side edge 19, annular lid seal 20 (on the underside of the lid 14) which provides and establishes a watertight hermetic (or aseptic) friction-seal with the inner perimeter wall surface 22 of tube 10. Specifically, lid 14 has a lower surface 17 (adjacent a lower annular sealing portion 20) which mates with upper perimeter wall surface 13. Lid extension 24 which is the subject of the present invention, is attached to the top of lid 14 within the half of the lid 14 distal from the lid hinge 16. The upper surface 26 of lid extension 24 is sloped away from lid hinge 16 at an obtuse angle 28 so that pushing on the lower surface 25 of lid extension 24 (in the direction shown by each arrow 30 in FIGS. 1 and 2 respectively) produces an upward component of force to unseat lid 14 and open the container. The width 32 (see FIG. 4) of lid extension 24 may be chosen to span only a portion of the width of lid 14. This design does not preclude use of an opener tool if so desired, derived from that of Warburg, U.S. Pat. No. 4,858,502. Such a tool (not shown) with adequate head space to accommodate lid extension 24 can be slid over lid 14 from front to back (direction shown by arrows 34, FIG. 4), to subsequently rest on and apply force to the two flanks 36 of lid 14 located on either side of lid extension 24 while also engaging the underside of lid lifting tab 18. The width 32 and length dimension 38 of lid extension 24 are chosen to be preferably ¼ inch or larger to facilitate finger manipulation, e.g., pushing and grasping of the lid extension 24. One or both surfaces 25 and 26 of the lid extension 24 are formed with an essentially flat geometry and a matte finish, or surface-modified subsequent to the molding process, to facilitate marking and identifying individual microcentrifuge sample tubes and improve the adhesion and retention of ink on the lid extension 24. The lid extension 24 is generally attached to that half of the lid's surface 14 distal from the lid hinge 16. This position of attachment for increased leverage, combined with the obtuse angle 28 of orienting the lid extension 24, facilitates unseating of the lid 14 and opening of the microcentrifuge tube 10.

In the practice of opening a frictionally sealed microcentrifuge tube 10 having a hinged lid 14 with an upwardly angled lid extension 24 described herein, the tube 10 is held in an operator's hand, a microcentrifuge tube storage rack 42 (FIG. 5) or in another holding means which immobilizes tube 10, and does not interfere with opening of the lid. Finger pressure, s thumb pressure is applied to the lid extension 24 generally in the direction of the lid hinge 16 to unseat the lid 14 and open the container.

Other embodiments are within the following claims.

I claim:

1. A microcentrifuge tube comprising a container having a round opening and a frictionally seated lid hingedly connected by a fixed hinge to said container, said lid having an upper lid surface and being sized and shaped to cover and seal said opening to maintain the inside of said tube free of any contaminant, wherein said lid comprises a lid extension extending upwardly at an angle between 20°-80° from said lid surface and outwardly away from said hinge in such a manner which allows the lid to be unseated and moved from the opening of said container when mechanical pressure by a user's finger is applied to the lid extension without contact with any other portion of said lid.

2. A microcentrifuge tube comprising:

a container having an upper opening defined by an inner perimeter wall having an upper perimeter wall surface, a lid hingedly attached to said container by a fixed-hinge, wherein said lid comprises a sealing wall having a lower surface and a lower annular sealing portion positioned adjacent said lower surface and extending downwardly from said lower surface, wherein said lower annular sealing portion is adapted to fit within said upper opening and sealingly mate with said inner perimeter wall, and wherein said lower surface is adapted to mate with said upper perimeter wall surface;

said lid further comprising an upper surface, and extending upwardly from said upper surface, a lid extension, said lid extension extending upwardly at an angle between 20°-80° from said upper surface and outwardly from said hinge in such a way that when said lower annular sealing portion is held within said upper opening of the container, said annular portion can be unseated from said opening by application of pressure by a user's finger to a surface of said lid extension without contact between the finger and said lower annular sealing portion of said lid.

3. The microcentrifuge tube of claim 1 wherein the underside of said lid comprises a downwardly extending annular portion shaped to sealing fit inside the round opening of the tube.

4. The microcentrifuge tube of claim 1 wherein said lid extension is formed as an integral part of a thermoplastic microcentrifuge tube lid.

5. The microcentrifuge tube of claim 1 wherein said lid extension is of a shape selected from the group consisting of a flat flap, a curved or rounded flap, and a horn-like projection on the top of the lid.

6. The microcentrifuge tube of claim 1 wherein said lid extension is at least $\frac{1}{4}$ inch in length.

7. The microcentrifuge tube of claim 1 wherein said lid extension is in the form of a flap, wherein at least one side of said flap comprises a surface capable of receiving and retaining indicia or sample identification markings.

8. The microcentrifuge tube of claim 1 wherein said lid extension is attached to said lid within the half of said lid distal from said hinge.

9. The microcentrifuge tube of claim 1 wherein the attachment position for said lid extension on top of said lid is indented from the edge of said lid opposite said hinge.

10. The microcentrifuge tube of claim 1 formed from polyethylene or polypropylene.

* * * * *